US010531701B2

(12) United States Patent
Guer

(10) Patent No.: US 10,531,701 B2
(45) Date of Patent: Jan. 14, 2020

(54) ATHLETIC SHOE HAVING CLEATS

(76) Inventor: Jean-Luc Guer, Marseilles (FR)

( * ) Notice: Subject to any disclaimer, the term of this patent is extended or adjusted under 35 U.S.C. 154(b) by 124 days.

(21) Appl. No.: 13/990,128

(22) PCT Filed: Nov. 29, 2011

(86) PCT No.: PCT/FR2011/052819

§ 371 (c)(1),
(2), (4) Date: Aug. 16, 2013

(87) PCT Pub. No.: WO2012/072949

PCT Pub. Date: Jun. 7, 2012

(65) Prior Publication Data

US 2013/0333249 A1 Dec. 19, 2013

(30) Foreign Application Priority Data

Nov. 29, 2010 (FR) ..... 10 59881

(51) Int. Cl.

*A43B 5/02* (2006.01)
*A43B 3/24* (2006.01)
*A43B 7/14* (2006.01)

(52) U.S. Cl.

CPC ..... *A43B 5/02* (2013.01)

(58) Field of Classification Search

CPC ..... A43B 7/144; A43B 7/1465; A43B 7/16; A43B 7/148; A43B 7/1485; A43B 5/02; A43B 3/246; A43B 13/36; A43B 13/14; A43B 17/18; A43B 13/02; A43B 21/52; A43B 3/0047; A43B 3/0052; A43B 7/149

USPC ..... 36/28, 37, 29, 30 A, 15, 36 R, 36 A, 36/36 C, 30 R

See application file for complete search history.

(56) References Cited

U.S. PATENT DOCUMENTS 1,476,690 A * 12/1923 Cohn ..... A43B 17/08 36/173
2,098,346 A * 11/1937 MacDonald ..... A43B 21/39 36/36 R
2,466,611 A * 4/1949 Nicoletti ..... A43B 21/39 36/36 R
3,081,774 A * 3/1963 Lelyveld ..... A43B 7/142 36/174

(Continued)

FOREIGN PATENT DOCUMENTS

DE 29715533 U1 * 1/1998 ..... A43B 13/36
WO WO 00/78171 12/2000
WO WO 2010/062539 6/2010

OTHER PUBLICATIONS

International Search Report as issued for PCT/FR2011/052819.

*Primary Examiner* — Anna K Kinsaul
*Assistant Examiner* — F Griffin Hall
(74) *Attorney, Agent, or Firm* — Pillsbury Winthrop Shaw Pittman LLP

(57) ABSTRACT

An athletic shoe having cleats, includes an upper and an outsole, wherein the outsole has a front portion capable of receiving the front of the foot, a central portion capable of receiving the middle of the foot, and a rear portion capable of receiving the heel. The rear portion of the outsole includes a hollow shell and a heel seat, the heel seat being removably arranged in a recess formed by the hollow shell, and the rear portion has a portion that is thickened relative to the front portion, the thickened portion being adjustable by modifying the thickness of the removable heel seat.

20 Claims, 6 Drawing Sheets

(56) References Cited

U.S. PATENT DOCUMENTS 3,290,801 A * 12/1966 Bente ..... A43B 5/06 36/129
3,432,945 A * 3/1969 Cesta ..... A43B 21/37 36/36 R
4,316,332 A * 2/1982 Giese ..... A43B 5/00 36/114
4,557,060 A * 12/1985 Kawashima ..... A43B 5/00 36/30 R
5,092,060 A * 3/1992 Frachey ..... A43B 1/0072 36/29
5,174,049 A * 12/1992 Flemming ..... A43B 1/0009 36/28
5,313,717 A * 5/1994 Allen ..... A43B 13/20 36/153
5,410,821 A * 5/1995 Hilgendorf ..... A43B 1/0081 36/100
5,469,639 A * 11/1995 Sessa ..... A43B 3/0057 36/28
5,689,902 A * 11/1997 Juang ..... A43B 21/32 36/141
5,732,481 A * 3/1998 Farhad ..... A43B 7/14 36/37
5,775,005 A * 7/1998 McClelland ..... A43B 1/0072 36/134
5,782,014 A * 7/1998 Peterson ..... A43B 1/0072 36/28
5,894,683 A * 4/1999 Lin ..... A43B 21/28 36/29
6,050,001 A * 4/2000 Ditrtrich ..... A43B 7/144 36/108
6,115,944 A * 9/2000 Lain ..... A43B 21/26 36/28
6,505,420 B1 * 1/2003 Litchfield ..... A43B 13/203 36/28
6,519,876 B1 * 2/2003 Geer ..... A43B 1/0081 36/102
6,973,746 B2 * 12/2005 Auger ..... A43B 1/0072 36/128
7,020,988 B1 * 4/2006 Holden ..... A43B 7/1425 36/141
7,168,184 B2 * 1/2007 Wallin ..... A43B 3/24 36/102
2003/0101619 A1 * 6/2003 Litchfield ..... A43B 13/203 36/29
2004/0216330 A1 * 11/2004 Swigart ..... A43B 7/144 36/29
2005/0028403 A1 * 2/2005 Swigart ..... A43B 13/20 36/28
2005/0193589 A1 * 9/2005 Bann ..... A43B 13/181 36/28
2005/0268491 A1 * 12/2005 McDonald ..... A43B 1/0063 36/28
2005/0269010 A1 * 12/2005 Chi ..... A43B 1/0027 156/60
2006/0042120 A1 * 3/2006 Sokolowski ..... A43B 13/125 36/29
2006/0086003 A1 * 4/2006 Tseng ..... A43B 13/20 36/29
2006/0283046 A1 * 12/2006 Mason ..... A43B 3/0042 36/28
2007/0227042 A1 * 10/2007 Chan ..... A43B 7/142 36/30 R
2009/0139114 A1 * 6/2009 Malek ..... A43B 7/144 36/3 B
2010/0095551 A1 * 4/2010 Gupta ..... A43B 7/144 36/29
2010/0186265 A1 * 7/2010 Evans ..... A43B 13/184 36/36 R
2011/0000101 A1 * 1/2011 Nakano ..... A43B 1/0072 36/12
2011/0162234 A1 * 7/2011 Dean ..... A43B 7/144 36/43
2012/0017467 A1 * 1/2012 Whitney ..... A43B 3/0031 36/31
2012/0137540 A1 * 6/2012 Vattes ..... A43B 3/128 36/11.5
2013/0167405 A1 * 7/2013 Forsey ..... A43B 7/144 36/92
2014/0109440 A1 * 4/2014 McDowell ..... A43B 3/246 36/103
2015/0013191 A1 * 1/2015 Brown ..... A43B 21/00 36/102
2017/0325544 A1 * 11/2017 Ngene ..... A43B 5/00

* cited by examiner

SECTION B-B

ATHLETIC SHOE HAVING CLEATS

CROSS-REFERENCE TO RELATED APPLICATIONS

This is the U.S. National Stage of PCT/FR2011/052819, filed Nov. 29, 2011, which in turn claims priority to French Patent Application No. 1059881, filed Nov. 29, 2010, the entire contents of all applications are incorporated herein by reference in their entireties.

The present invention concerns an athletic shoe having cleats, in particular for the practice of football, rugby, or other.

For the sportsman, and in particular for the footballer, the foot is an essential tool in the practice of his sport. Two footballers can be differentiated by the quality of their pass or their shot, the technique being liable to take more importance with one than with the other.

It is in this perspective of improvement of certain performances by sportsmen that the manufacturers have developed shoes which permit, for example, an influencing and/or improving of the handling of the ball, the quality of the shot or the stability for a good field/shoe grip.

The expansion of the economic environment and research continues with a view to new performances for the sportsman, in particular for the footballer, imposing on the latter an increase in the frequency and intensity of training sessions and matches.

Paradoxically, shoes having cleats, in particular for the practice of football, have scarcely evolved technically in recent years in response to the new demands of effort, speed, engagement and distance covered by the players.

By comparison, the shoes used in other sports disciplines and in particular disciplines in which great distances are covered, such as running or basketball, have known constant evolutions allowing the increasing expectations of the sportsmen to be met.

By way of illustration, in the case of running, numerous models of shoes meet specifically the expectations of each runner and allow training sessions and/or races over long distances to be undertaken whilst minimizing the physical fatigue of the sportsman. Thus, supinator shoes, pronator shoes, shoes for training with a more resistant sole, very light shoes for competition, etc. will be found.

In this context, the invention aims to provide an athletic shoe having cleats permitting a shoe to be provided in line with the various technical, mechanical and anatomical demands of sportsmen so as to reduce the physical fatigue of the sportsman, to reduce overuse and the risk of acute injury, and to thus promote the performance of the sportsman.

To this end, the invention proposes an athletic shoe having cleats comprising an upper and an outsole, the said sole having a front portion capable of receiving the front of the foot, a central portion capable of receiving the middle of the foot, and a rear portion capable of receiving the heel; the said shoe being characterized in that the said rear portion of the said outsole consists of a hollow shell and a heel pad, the said heel pad being removably arranged in a recess formed by the said hollow shell and in that the said rear portion has a portion that is thickened relative to the said front portion, the said thickened portion being adjustable by modifying the thickness of the said removable heel pad.

Owing to the presence of a removable heel seat which is interchangeable rapidly and without difficulty, the user can modify the technical characteristics of the shoe by putting in place another heel pad having different mechanical properties, in particular at the level of damping, shock absorption or the recovery of energy.

By varying the thickness of the selected heel pad, the user can also adjust the raising of the heel with respect to the front of the foot. The user therefore has the possibility of optimizing his shoe as a function of his physical attributes, which allows the risk to be considerably reduced of the occurrence, particularly in the high-level sportsman, of certain insidious and recurrent mechanical pathologies due to the current demands.

The shoe according to the invention is thus versatile, perfectible and capable of adapting to the various technical, mechanical and anatomical demands of the sportsmen.

According to a preferred characteristic of the invention, the said heel pad fills up the whole of the heel area of the said shoe. The filling up of the whole of the heel area by this heel pad provides a better sitting of the heel as a whole and optimizes the mechanical functions of the foot, which promotes a better static, dynamic and postural balance; contrary to a single isolated element, situated solely opposite a portion of the plantar face of the heel, which would therefore only provide a partial gain in damping but which would in no case improve the static, dynamic or postural balance.

The athletic shoe having cleats according to the invention can comprise, in addition to the preferred characteristics previously mentioned, one or more of the following characteristics, considered individually or according to all the technically possible combinations:

- the said heel pad is removable from the interior of the said upper;
- the said thickened portion is comprised between 1 and 25 mm, preferably between 10 and 15 mm;
- the said shoe comprises means for retaining the said removable heel pad in position in the said recess;
- the said retaining means comprise an H-shaped protuberance capable of cooperating with an impression of complementary shape to ensure a locking in longitudinal and transverse translation of the said heel pad in the said recess;
- the said heel pad comprises a pull tab to facilitate its extraction from the said recess;
- the said shell and the said heel pad extend in the central portion of the said outsole;
- the said heel pad is made from a more flexible and more deformable material than that constituting the said shell;
- the said heel pad is made from several superimposed layers of materials having different mechanical properties;
- the said heel pad has in its width at least two materials provided with different mechanical properties;
- the said heel pad has an upper face forming a horizontal plane or an inclined plane of angle $\alpha$;
- the said inclined plane of angle $\alpha$ forms an inclination, designated transverse, in the transverse direction of the said shoe and/or an inclination, designated longitudinal, in the longitudinal direction of the shoe;
- the said angle $\alpha$ is comprised between 1 and 10 degrees, preferably 4 or 5 degrees;
- the said heel pad has an upper face having a concavity;
- the said hollow shell is obtained in a transparent or translucent material;
- the said central portion comprises an incurved exterior profile;

the said central portion comprises an incurved interior profile and capable of fitting the shape of the plantar arch of the foot.

The present invention also has as an object a pair of athletic shoes having cleats, characterized in that it comprises two of said shoes according to the invention and in that the removable heel pads of the two said shoes have different characteristics.

The present invention also has as an object a removable heel pad having a shape adapted to cooperate in a complementary manner with the hollow recess formed by the hollow shell of an athletic shoe having cleats according to the invention.

Other characteristics and advantages of the invention will emerge more clearly from the description which is given below, by way of indication and in no way by way of limitation, with reference to the attached figures, in which.

Figure 7A:
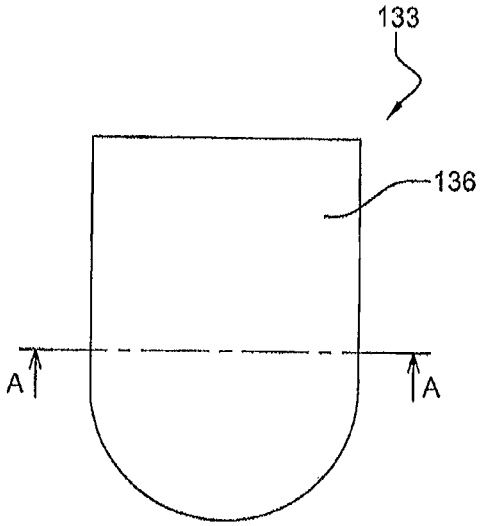
Figure 7B:
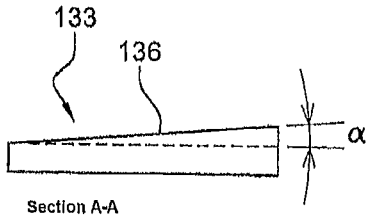
Figure 8A:
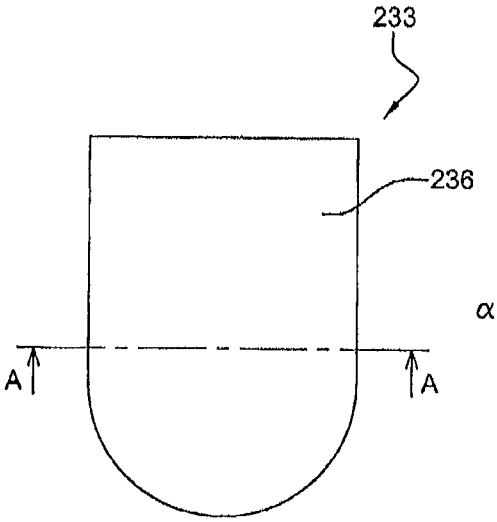
Figure 8B:
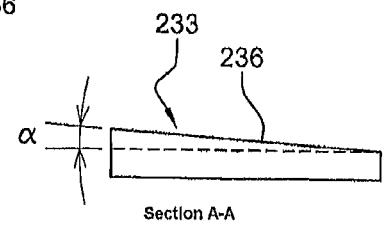
Figure 9A:
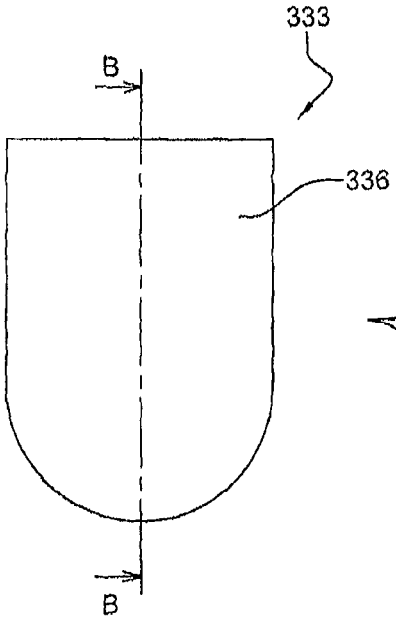
Figure 9B:
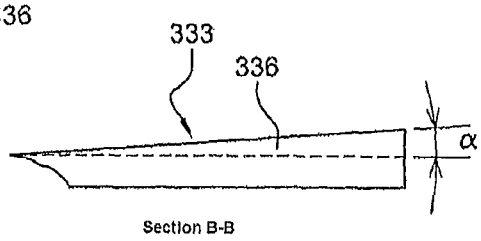
Figure 10A:
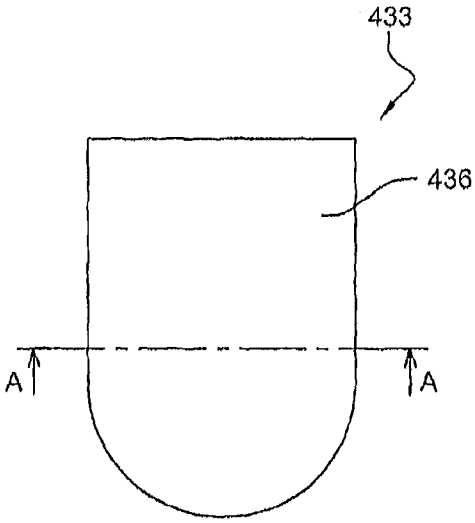
Figure 10B:
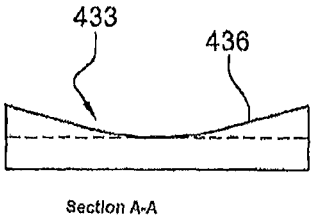
Figure 11A:
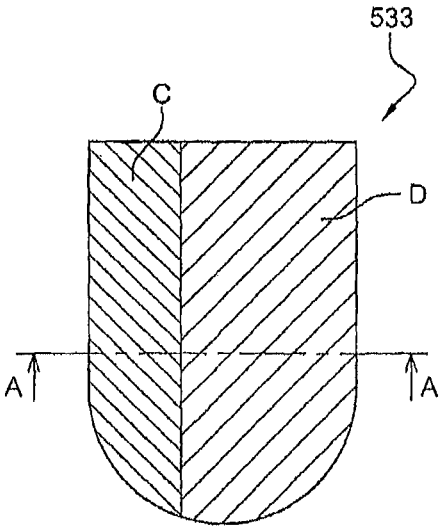
Figure 11B:
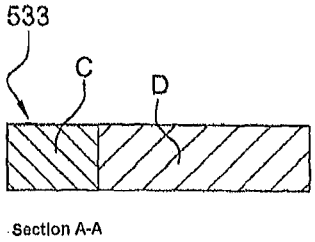
Figure 12A:
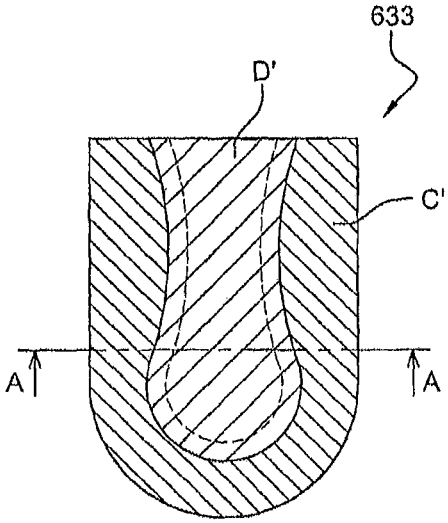
Figure 12B:
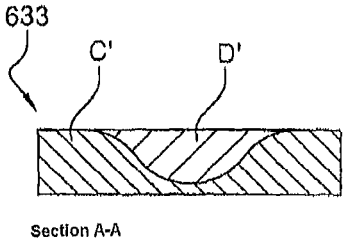

FIGS. 7*a* and 7*b* represent respectively a top view and a side view of the removable heel pad of a shoe according to a second embodiment of the invention;

FIGS. 8*a* and 8*b* represent respectively a top view and a side view of the removable heel pad of a shoe according to a third embodiment of the invention;

FIGS. 9*a* and 9*b* represent respectively a top view and a side view of the removable heel pad of a shoe according to a fourth embodiment of the invention;

FIGS. 10*a* and 10*b* represent respectively a top view and a side view of the removable heel pad of a shoe according to a fifth embodiment of the invention;

FIGS. 11*a* and 11*b* represent respectively a top view and a side view of a variant embodiment of the removable heel pad of a shoe according to the invention;

FIGS. 12*a* and 12*b* represent respectively a top view and a side view of a variant embodiment of the removable heel pad of a shoe according to the invention.

In all the figures, the common elements bear the same reference numbers.

Figure 1:
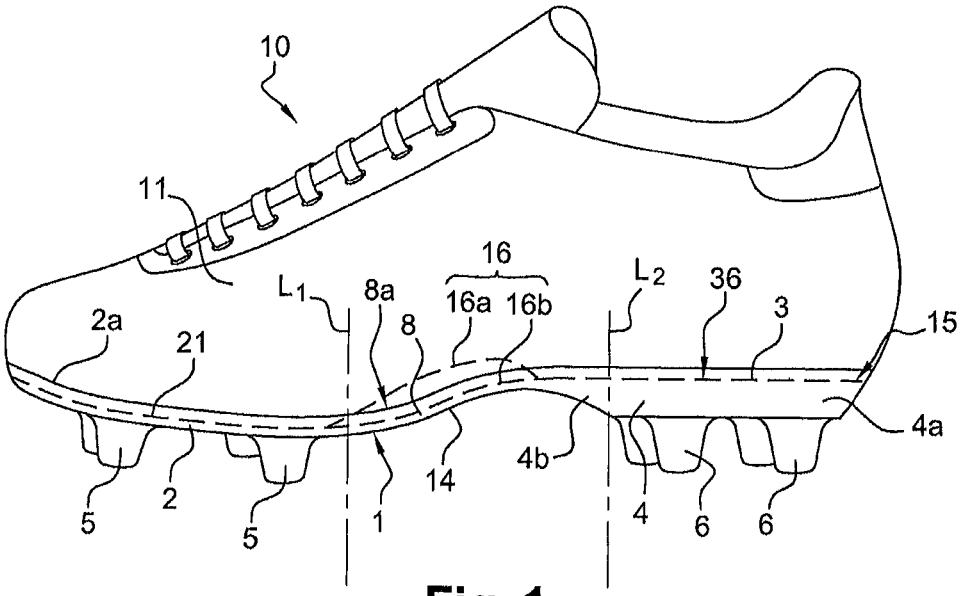
FIG. 1 represents an external side view of an athletic shoe having cleats according to the invention.

The shoe 10 according to the invention and illustrated in FIG. 1 comprises an outsole 1 extending from the front to the back of the shoe 10 and integral with an upper 11.

In a known manner, the upper 11 is capable of receiving and covering the whole of the foot. The upper is made by means of several flexible pieces of leather, fabric or any other synthetic material known to the person skilled in the art.

The outsole 1 comprises three distinct portions each fulfilling a role in the retaining and the positioning of the foot in the shoe:

a first portion 2 situated at the front of the shoe permitting the supporting of the front of the foot, designated hereinafter the front portion 2;

a second portion 3 situated at the rear of the shoe permitting the supporting of the heel, designated hereinafter the rear portion 3; and a third portion 8 situated between the two others, ensuring the supporting of the middle of the foot, designated hereinafter the central portion 8.

Each of the portions is defined and dimensioned so as to form an overall plantar profile 15 offering as enveloping a support of the foot as possible, thus preserving the anatomical and biomechanical balance of the sportsman.

Figure 2:
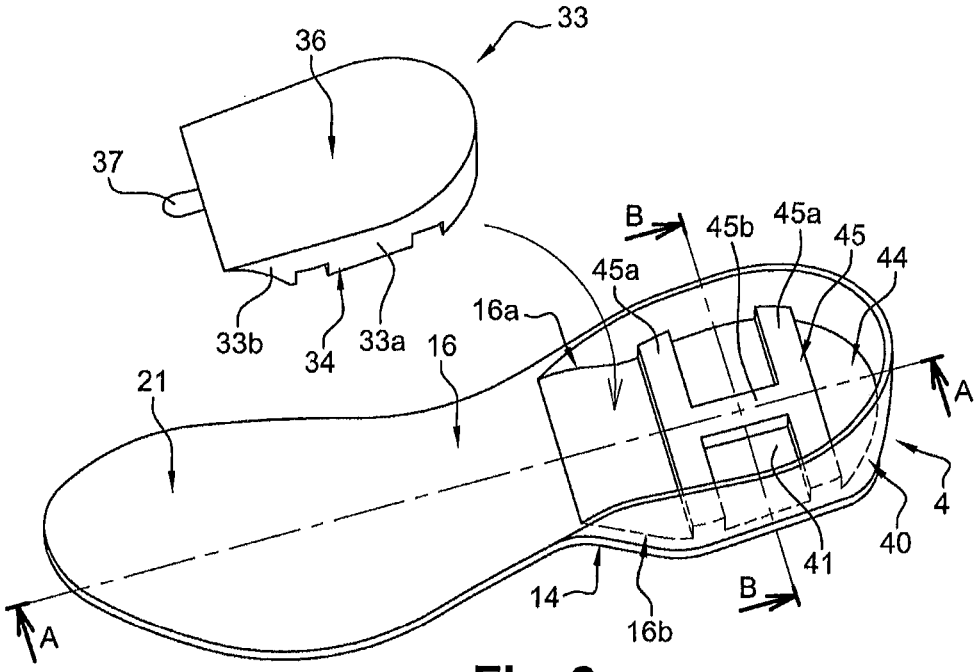
FIG. 2 represents a view in perspective and in low angle view of the outsole of the shoe according to the invention, with the heel pad which is removed from its recess.
Figure 3:
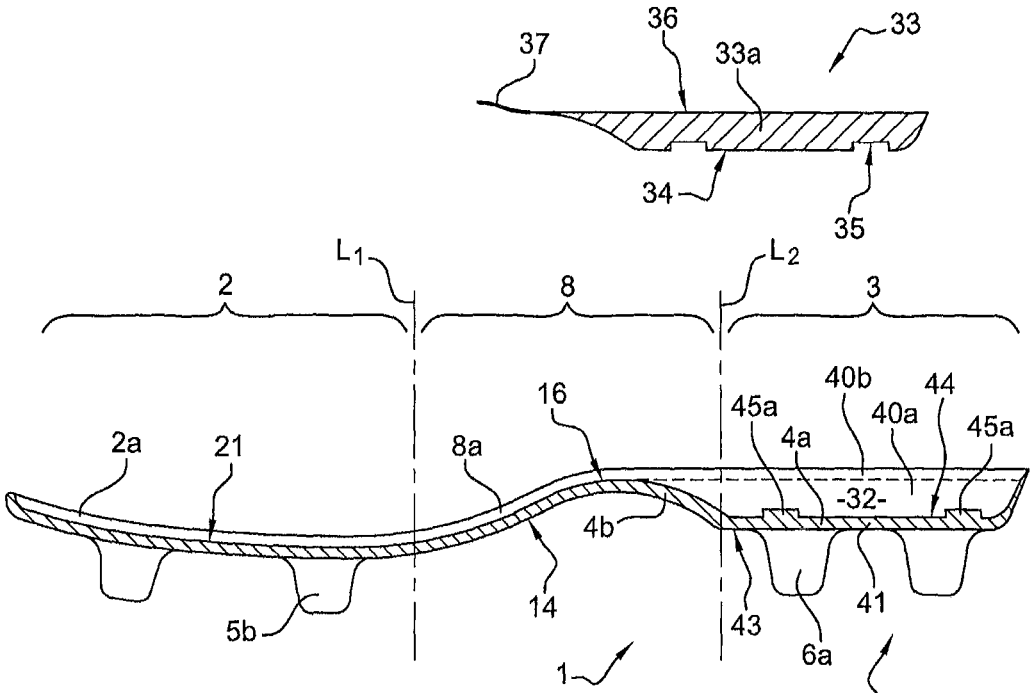
FIG. 3 represents a view in longitudinal section of the outsole in the configuration of FIG. 2 and according to the plane A-A of this figure.
Figure 4:
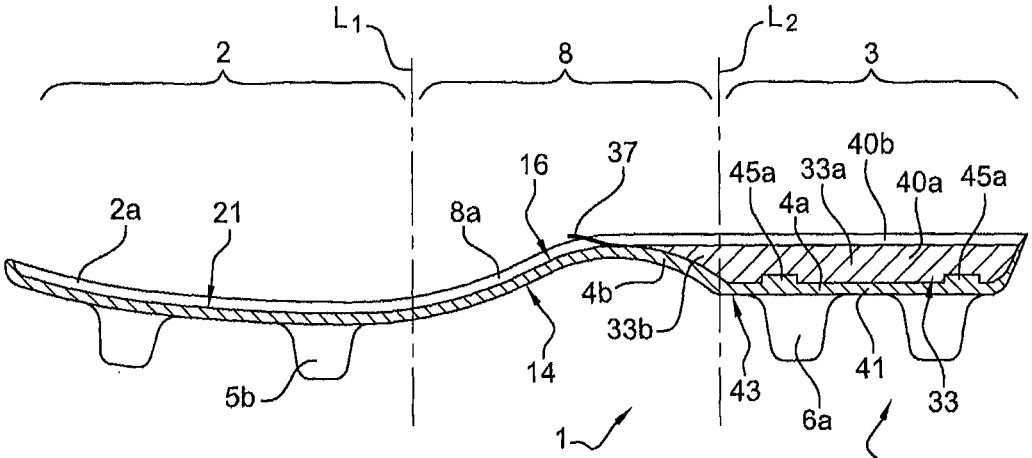
FIG. 4 represents a view in longitudinal section of the outsole, still according to the plane A-A but with the heel pad which is put in place in its recess.

The outsole 1, represented in FIGS. 2 to 4, comprises a plurality of cleats 5 and 6 which are arranged and distributed respectively on the exterior side (i.e. the side in contact with the ground) of the front portion 2 and of the rear portion 3.

A cleat is defined in a general manner as an element, generally a rigid protuberance, equipping the sole of certain types of athletic shoes so as to ensure a better adherence to the ground, and in particular to soft or grassy ground.

Thus, also a cleat is considered to be the different elements known to the person skilled in the art permitting a better adherence to the ground to be ensured, known in particular under various names: strip, tread, etc.

In the embodiment of the invention illustrated in the figures, the cleats 5 and 6 are cleats designated as "moulded" and are therefore integral and produced during the moulding of the outsole 1.

In a variant, these cleats can be screwed cleats of plastic or metallic material by ad hoc fixing means.

The cleats 5 and 6 are equally cleats of conical, cylindrical, lamellar or any other shape permitting an adherence to the ground to be ensured.

More precisely, the front portion 2 extends from the front of the shoe up to the straight line L1 represented in dotted lines in FIGS. 1 to 4, corresponding substantially to the position of the cleats 5*b* (the front cleats situated most to the rear).

The rear portion 3 extends from the straight line L2 represented in dotted lines on these same FIGS. 1 to 4, corresponding substantially to the position of the cleats 6*a* (the rear cleats situated most to the front of the shoe).

The central portion 8 is the portion extending between the front portion 2 and the rear portion 3, i.e. between the straight lines L1 and L2.

The front portion 2 has a small thickness of a few millimetres (preferably less than 5 mm), substantially constant except at the level of its periphery 2*a* (FIGS. 3 and 4) which is slightly raised to be fixed to the upper 11 by ad hoc fixing means such as gluing or overmoulding.

It has an interior surface profile 21 (i.e.: the interior plantar face) which is slightly curved, the front portion of which is slightly raised with respect to its rear portion, so as to have a maximum support on the ground during the digitigrade phase, i.e. during the period of walking or running during which the support of the foot is determined on the front of the foot.

This front portion 2 allows the front of the foot to be supported, and more precisely the anterior transverse arch and also the anterior supports essentially formed by the heads of the first metatarsal and of the fifth metatarsal.

The rear portion 3 of the outsole 1 is constituted by an exterior rigid and hollow shell 4 forming a recess 32, and a heel pad 33 removably arranged inside this recess 32 (FIGS. 2 to 4).

In the embodiment illustrated in the figures, the shell 4 and the heel pad 33 extend slightly in the central portion 8.

Thus, the rear portion 3 comprises the respective main portions 4*a* and 33*a* of the shell 4 and of the heel pad 33, whilst the central portion 8 comprises their extensions 4*b* and 33*b*.

The shell 4 is formed by a base wall 41 and by a lateral peripheral wall 40 extending vertically from the base wall 41 (FIGS. 2 and 3).

Figure 6:
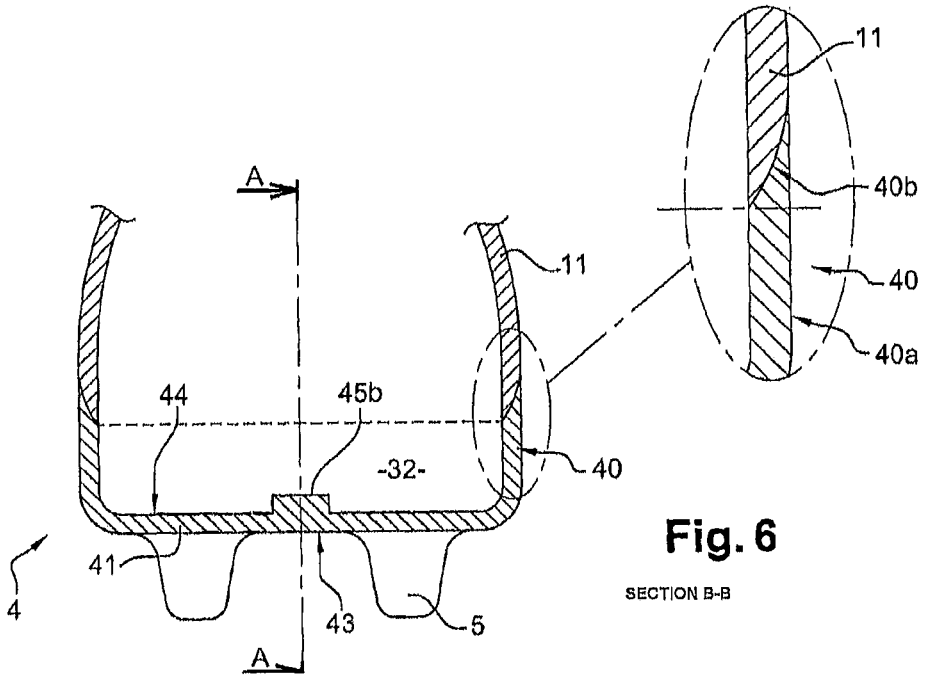
FIG. 6 represents a view in transverse section of the shoe according to the invention without its heel pad according to the plane B-B of FIG. 2.

The walls 40 and 41 of the shell 4 delimit the recess 32, the transverse section of which, according to the section plane B-B of FIG. 2, is substantially in a U-shape (FIG. 6).

The base wall 41 has:

an exterior face 43 on which the cleats 6 are fixed;

an interior face 44 comprises an H-shaped protuberance 45, the two parallel arms 45*a* of which extend transversely to the longitudinal axis of the sole over its entire width, whilst the central bar 45*b* extends between the two arms 45*a* according to the longitudinal axis of the sole 1 (FIG. 2).

The arms 45*a* and the bar 45*b* have a width of approximately 10 mm for a thickness of approximately 1.5 mm.

This base wall 41 has a thickness which is substantially constant and equal to that of the front portion 2 of the sole 1 except at the level of its protuberance 45.

The peripheral lateral wall 40 also has along its lower portion 40*a* a constant thickness comprised between 1 and 5 mm.

The upper portion 40*b* of the peripheral lateral wall 40 becomes progressively thinner towards its free end, its interior face having a concave profile fitting the shape of the upper 11 to which this upper portion 40*b* is fixed by ad hoc fixing means such as gluing or overmoulding (FIG. 6).

In the main portion 4*a* of the shell 4 (portion contained in the rear portion 3 of the outsole 1), the base wall 41 is flat (except at the level of the protuberance 45) whilst the lower portion 40*a* has a constant height comprised between 1 and 25 mm, and preferably between 10 and 15 mm.

In the extension portion 4*b* of the shell 4 (portion contained in the central portion 8 of the outsole 1), the base wall 41 adopts an incurved bevelled profile whilst the lower portion 40*a* sees its height reduce progressively towards the front and following this profile (FIGS. 1 and 4).

The upper portion 40*b* has a constant height in the whole of the shell 4, determined as a function of the desired rigidity for the rear of the shoe 1, this rigidity being all the greater, the greater the fixing zone is between the shell 4 and the upper 11.

The extension portion 4*b* thus ensures a gentle transition between the rear portion 3 and central portion 8 of the outsole 1. This portion 4*b* also permits the rear zone of the central portion 8 to be maintained and reinforced by providing an enveloping and a supplementary support at the level of the middle of the foot.

According to variants which are not represented, the shell 4 and the heel pad 33 extend over the entirety of the central portion 8 or, on the contrary, are circumscribed at the rear portion 3.

The shell 4 is moulded in a single piece with the front portion 2 and central portion 8 of the outsole 1, in a plastic material, preferably of the thermoplastic or thermosetting type, reinforced if necessary by fibres of the nylon, glass or other type.

The shell 4 is a rigid shell which is not deformable under the weight of the sportsman.

The heel pad 33 has a shape complementary to the recess 32, permitting it to perfectly fit the internal faces of the lateral wall 40 and base wall 41 of the shell 4.

Figure 5:
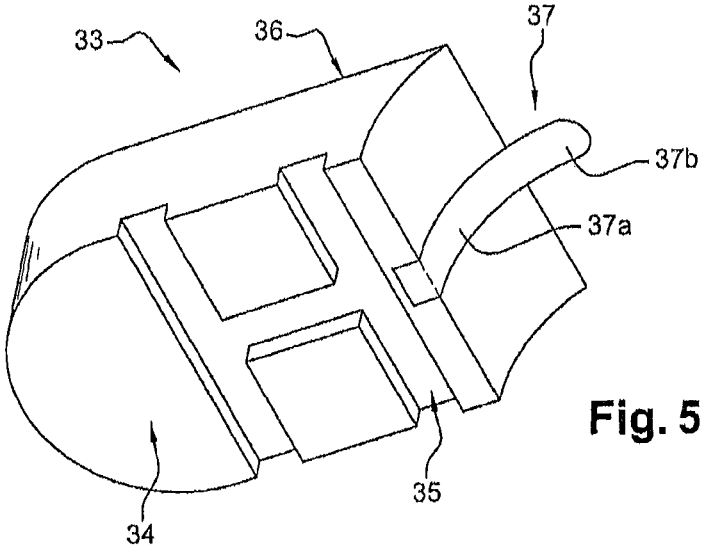
FIG. 5 represents a view in perspective from below of the heel pad of the sole of FIGS. 2 to 4.

The heel pad 33 comprises in particular on its lower face 34 an H-shaped impression 35 to receive the protuberance 45 which the interior face 41 of the shell 4 comprises (FIG. 5).

Once inserted in the recess 32, the cooperation between the protuberance 45 and the impression 35 thus permits a locking in longitudinal and transverse translation of this heel pad 33 to be ensured.

The upper face 36 (here substantially flat) of the heel pad 33 constitutes the interior surface profile (i.e.: the interior plantar face) on which the heel comes to rest.

The heel pad 33 has a minimum base thickness, obtaining the rear raising of the heel and of the shoe. This thickness is substantially equal to the height of the lower portion 40*a* of the peripheral lateral wall 40 of the shell 4.

This thickness of the heel pad 33 is thus constant overall in its main portion 33*a* (portion contained in the rear portion 3 of the outsole 1) then reduces progressively towards the front in its extension portion 33*b* (portion contained in the central portion 8 of the outsole 1) according to a substantially concave bevelled profile (FIG. 4).

Once put in place through the interior of the upper 11, this heel pad 33 therefore fills up the hollow recess 32 up to the demarcation between the lower portion 40*a* and upper portion 40*b* of the lateral wall 40 (FIG. 6), which permits the possible problems of inequalities of length of the lower limbs to be re-balanced, without modifying the volume of the upper at the level of the heel or interfering with the fitting height of the heel in the shoe.

The heel pad 33 according to the invention permits the filling up of the whole of the heel resting point and not solely an isolated zone situated opposite the plantar face of the heel.

In a variant, the heel pad 33 can have a difference in thickness of +/−4 mm with the height of the lower portion 40*a* of the peripheral lateral wall 40.

FIGS. 7*a*, 7*b*, 8*a*, 8*b*, 9*a*, 9*b*, 10*a* and 10*b* illustrate other embodiments of the invention in which the removable heel pad has a different configuration.

In each of these embodiments, the heel pad has a minimum base thickness providing a posterior raising of the heel.

By reducing the negative tensions of anchorage of the posterior chain on the foot, this basic thickness permits the beneficial effects to be optimized which belong to each of the presented embodiments.

In the embodiment illustrated in FIGS. 7*a* and 7*b*, the upper face 136 of the heel pad 133 forms an inclined plane of angle α, the inclination of which is oriented from the external side towards the internal side of the sole (transverse inclination of the heel pad). Preferably, the angle α is comprised between 1 and 10 degrees, for example 4 or 5 degrees. This particular embodiment permits a rebalancing of the heel by a placing in pronation of the hindfoot, which provides a better static, dynamic and postural balance for a user having, for example, a foot varus or a genu varum.

In the embodiment illustrated in FIGS. 8*a* and 8*b*, the upper face 236 of the heel pad 233 forms an inclined plane of angle α, the inclination of which is oriented from the internal side towards the external side of the sole (transverse inclination of the heel pad). Preferably, the angle α is comprised between 1 and 10 degrees, for example 4 or 5 degrees. This particular embodiment permits a rebalancing of the heel by a placing in supination of the hindfoot, which provides a better static, dynamic and postural balance for a user having, for example, a foot valgus or a genu valgum.

In the embodiment illustrated in FIGS. 9*a* and 9*b*, the upper face 336 of the heel pad 333 forms an inclined plane of angle α, the inclination of which is oriented from the rear towards the front of the sole (longitudinal inclination of the heel pad). Preferably, the angle α is comprised between 1 and 10 degrees, for example 4 or 5 degrees. This particular embodiment permits a placing in plantar flexion of the hindfoot, which provides a better static, dynamic and postural balance for a user having, for example, a genu recurvatum.

In this embodiment illustrated in FIGS. 10*a* and 10*b*, the upper face 436 of the heel pad 433 has a concavity extending over the whole of its surface and the main axis of which is situated in the median plane of this heel pad. Preferably, the radius of curvature of the concavity is comprised between 50 and 150 mm, for example 75 mm. This particular embodiment permits the stability of the heel to be improved by an enveloping support of the hindfoot, which provides a better static, dynamic and postural balance for a user having, for example, a lateral, even bilateral, instability of the ankle.

According to variant embodiments (not represented) of the form illustrated in FIGS. 10*a* and 10*b*, the main axis of the concavity can be positioned between the internal third and the external third of the width of the heel pad. These variant embodiments permit the stability of the heel to be improved by an active support of the hindfoot internally (or externally), which provides a better static, dynamic and postural balance for a user having, for example, a dominant internal (or external) lateral instability of the ankle after a sprain of the internal (or external) lateral ligament.

The heel pad 33, 133, 233, 333, 433 can be obtained in a polymer, or other, material, selected for its mechanical properties so as to provide a supplementary characteristic to the athletic shoe.

For example, the heel pad 33, 133, 233, 333, 433 can be made in a slightly flexible and deformable material, such as a reticulated foam, so as to provide a damping function to the shoe.

It can further comprise bubbles, cells or tubular apertures and/or springs so as to improve the damping, anti-vibration and/or feedback functions.

The heel pad can also comprise on its upper surface 36, 136, 236, 336, 436 a plurality of points or various reliefs considered according to the sought proprioceptive interest. The presence of points permits, for example, the stimulation of the plantar receptors so as to engage the proprioceptive balance of the hindfoot and to thus induce the working of the lateral stabilisers of the ankle for a user having, for example, repetitive sprains.

The heel pad 33, 133, 233, 333, 433 can also comprise several distinct materials.

It can be formed in particular by a plurality of superimposed layers of materials having different mechanical properties (damping, stability, shock wave absorption properties, or of absorption of the vibrations which give rise to various mechanical pathologies).

The materials constituting the heel pad can also be arranged differently, as illustrated for example in FIGS. 11*a*, 11*b*, 12*a* and 12*b*.

According to the variant embodiment illustrated by FIGS. 11*a* and 11*b*, the first material C extends from the internal side of the heel pad 533 up to the demarcation with the second material D which extends up to the external side of this heel pad 533. Preferably, the demarcation between the two materials C and D is situated in the zone comprised between the internal third and the external third of the width of the sole, for example at the level of the median plane.

This particular arrangement permits different densities to be obtained between the internal and external sides (transverse direction) of the heel pad so as to improve the functional comfort of the heel inside and outside, which provides a better distribution of the stresses on the hindfoot both statically and dynamically for a user having, for example, a cutaneous under-heel pain (plantar callus) or an aponeurotic pain (calcaneal spur).

According to the variant embodiment illustrated by FIGS. 12*a* and 12*b*, the first material C' in the form of a heel ring extends on the periphery of the heel pad 633 and encloses the second material D' having a lesser density and situated in the upper and central part of the heel pad 633.

This particular arrangement permits the relieving of the plantar tuberosity of the heel to be improved by an active support of the lateral plantar pad, which provides a better distribution of the loads on the foot both statically and dynamically for a user having, for example, a disabling sub-heel pain.

Thus, the removable heel pad 33, 133, 233, 333, 433, 533, 633 permits, by a strategic and astute choice of a material or of a mix of materials, the provision of additional properties of damping, stability, absorption of the shock waves which are harmful to the anatomical structures, or of absorption of the vibrations which give rise to various functional pathologies in the sportsman.

Owing to its removable nature, the heel pad 33, 133, 233, 333, 433, 533, 633 can be easily replaced through the interior of the upper 11. It suffices for the user to insert his hand inside the upper 11 through its opening, to lift the insole (not represented in the figures) which generally covers the whole of the outsole 1, then to withdraw the heel pad 33, 133, 233, 333, 433, 533, 633 from its recess 32 and to replace it by another heel pad having different mechanical properties.

So as to facilitate the withdrawal of the heel pad 33, 133, 233, 333, 433, 533, 633 by the user, it may further comprise a pull tab 37 (FIG. 5).

This pull tab 37 can be constituted by a strip of flexible film (of plastic, fabric, . . . ), a first portion 37*a* of which is glued on the front face of the heel pad, whilst a second portion 37*b* is projecting so as to permit it to be gripped by the user's fingers (FIG. 5).

The heel pad 33, 133, 233, 333, 433, 533, 633 can also have on its surface various indications (colour codes, names) of its mechanical properties, which permits the user to select it from others depending on the characteristics which are sought (for example, flexibility or, on the contrary, rigidity).

So as to permit the heel pad mounted in the shell to be identified from the exterior of the shoe, the shell can be obtained in a substantially transparent or translucent material, allowing the mentioned indications to appear on the heel pad.

Furthermore, the fact of using a transparent or translucent material for the shell 4 permits the user to modify the aesthetic finish, of his shoe, by inserting a personalized heel pad (colours, designs, text, etc. . . . ).

Thus, the heel pad constitutes an element which can be entirely modified and personalized both with regard to its mechanical properties and its aesthetic appearance.

The rear portion 3 of the outsole 1 which has just been described has a thickened portion relative to the front portion 2.

This thickened portion provided by the peripheral lateral wall 40 of the shell 4 and by the heel pad 33, 133, 233, 333, 433, 533, 633, is comprised between 1 and 25 mm (and preferably between 10 and 15 mm so as to provide an optimum raising of the heel with respect to the front of the foot).

Furthermore, the tangent planes respectively to the interior surface profile 21 (on which the front of the foot rests) and to the interior surface profile 36 (on which the heel rests) are inclined slightly with respect to one another (angle comprised between 0 and 10°), such that the front of the foot and the heel rest on quasi-parallel planes, which further improves the biomechanical characteristics of the shoe.

Just as the front portion 2, the central portion 8 of the sole 1 has a small thickness of a few millimetres (preferably less than 5 mm), which is substantially constant except at the level of its periphery 8*a* which is slightly raised to be fixed to the upper 11 by ad hoc fixing means such as gluing or overmoulding (FIG. 4).

This central portion 8 has an exterior surface profile 14 (i.e.: the exterior plantar face) which is incurved and in the form of an arch which creates the exterior longitudinal curvature of the shoe. This curvature is all the more pronounced, the greater the difference in thickness is between the front portion 2 and the rear portion 3.

The central portion 8 has an interior surface profile 16 (i.e.: the interior plantar face) which is also incurved in the form of an arch which creates the interior longitudinal curvature of the shoe.

The incurvation of the interior surface profile 16 varies according to the transverse axis of the shoe so as to fit the shape of the plantar arch of the middle of the foot and to support it properly.

Thus, the internal profile 16*a* of this interior surface profile 16 has a greater arch effect than its external profile 16*b* just as the internal arch of the middle of the foot which comprises a greater arch effect than that of its external arch (FIG. 2).

The interior and exterior longitudinal curvatures permit the longitudinal arches of the foot to be better contained and better enveloped and also permit the bearing surface of the plantar supports to be increased, limiting the fatigability of the sportsman. The loads and the pressures on the foot are therefore better distributed during walking, running, jumping, taking support on the ground, changes of direction, etc.:

- the transmission of the forces and loads from the hindfoot towards the middle of the foot, and up to the front of the foot, by limiting the tension stresses on the whole of the posterior muscular chain.

The particular curvature of the central portion thus preserves the biomechanical activity of the plantar arches of the middle of the foot so as to optimize the physiological qualities of the foot as a whole, i.e. stability, absorption, elasticity, propulsion and drainage.

The central portion 8 can also be made in a different material from the front portion 2 and from the rear portion 3 so as to provide an additional technical characteristic to the athletic shoe, such as for example a better stability, in particular in torsion, between the front portion 2 and the rear portion 3 by the use of a plastic material which is more rigid than the material of the outsole 1 or by the addition of an intermediate shell or an additional tongue increasing the lateral rigidity of the whole. For example, this central portion 8 can be made in a feedback material (of the carbon type) so as to improve the propulsion.

The athletic shoe according to the invention thus constitutes a basic link in the prevention, the protection and the improvement of the performance of the sportsman.

It presents, furthermore, the following additional advantages:

- limitation of the risks of injury;
- protection and combatting against mechanical and physiological pain;
- preservation of the biomechanics of the lower limbs, of the pelvis and of the back;
- improvement of the venous system of effort;
- improvement of the plantar venous drainage and of the lower limbs promoting the elimination of toxins;
- improvement of performance;
- improvement and respect of the three arches and the three support pillars of the foot;
- improvement of comfort;
- no modification of the volume of the existing upper, which gives rise to a low development cost and permits the use of the volume of the upper for the adaptation of customized plantar orthoses.

It is obvious that other embodiments can be envisaged without departing from the scope of the invention, the latter being in no way limited to the examples which are described and represented.

In particular, although the embodiments described above concern a football boot, the invention can also concern shoes provided for the practice of other sports such as rugby, American football, baseball, or other sports.

The invention claimed is:

1. An athletic shoe having cleats comprising an upper and an outsole, said outsole having a front portion capable of receiving a front of a foot, a central portion capable of receiving a middle of the foot, and a rear portion capable of receiving a heel of the foot, wherein said rear portion of said outsole includes a hollow shell and a heel pad, said heel pad being removably arranged in a recess formed by said hollow shell and said hollow shell including an inner peripheral lateral wall having an even surface that completely covers and contacts at least one of two longitudinal sides of the heel pad when the heel pad is arranged in the recess, wherein said rear portion has a portion that is thickened relative to said front portion, said thickened portion being adjustable by modifying the thickness of said removable heel pad, wherein said heel pad has an upper face, a lower face, a front side, a rear side that is opposite the front side, and said two longitudinal sides, each of the two longitudinal sides connecting the rear side to the front side of the heel pad, and each of the two longitudinal sides extending along a longitudinal direction of the athletic shoe when the heel pad is arranged in the recess, and wherein the front side of the heel pad forms an incurved lateral face that is a most forward lateral portion of the heel pad, said incurved lateral face to be positioned at said central portion and extending from said lower face to said upper face of the heel pad to connect the lower face to the upper face at said central portion and said incurved lateral face being incurved along the longitudinal direction of the athletic shoe when the heel pad is arranged in the recess so that a thickness of the heel pad decreases progressively towards said front portion of the athletic shoe.

2. The athletic shoe having cleats according to claim 1, wherein said heel pad fills up the whole of a heel surface of said shoe.

3. The athletic shoe having cleats according to claim 1, wherein said heel pad is removable from an interior of said upper.

4. The athletic shoe having cleats according to claim 1, wherein said thickened portion is comprised between 1 and 25 mm.

5. The athletic shoe having cleats according to claim 1, comprising a retaining device configured to retain said removable heel pad in position in said recess.

6. The athletic shoe having cleats according to claim 5, wherein said retaining device comprises an H-shaped protuberance capable of cooperating with an impression of complementary shape to ensure a locking in longitudinal and transverse translation of said heel pad in said recess.

7. The athletic shoe having cleats according to claim 1, wherein said heel pad comprises a pull tab to facilitate its extraction from said recess.

8. The athletic shoe having cleats according to claim 1, wherein said shell and said heel pad extend in the central portion of said outsole.

9. The athletic shoe having cleats according to claim 1, wherein said heel pad is made from a more flexible and more deformable material than that constituting said shell.

10. The athletic shoe having cleats according to claim 1, wherein said heel pad is made from several superimposed layers of materials having different mechanical properties.

11. The athletic shoe having cleats according to claim 1, wherein said heel pad has in its width at least two materials provided with different mechanical properties.

12. The athletic shoe having cleats according to claim 1, wherein said upper face forms a horizontal plane or an inclined plane of angle ($\alpha$).

13. The athletic shoe having cleats according to claim 12, wherein said inclined plane of angle ($\alpha$) forms an inclination in the transverse direction of said shoe and/or an inclination in the longitudinal direction of the shoe.

14. The athletic shoe having cleats according to claim 1, wherein said angle ($\alpha$) is comprised between 1 and 10 degrees.

15. The athletic shoe having cleats according to claim 1, wherein said upper face has a concavity.

16. The athletic shoe having cleats according to claim 1, wherein said central portion comprises an incurved exterior profile.

17. The athletic shoe having cleats according to claim 1, wherein said central portion comprises an incurved interior profile and is capable of fitting the shape of a plantar arch of the foot.

18. A pair of athletic shoes having cleats, comprising two shoes according to claim 1, and wherein the removable heel pads of said shoes have different characteristics.

19. A removable heel pad having a shape adapted to cooperate in a complementary manner with a shape of a hollow recess formed by a hollow shell of an athletic shoe having cleats, the athletic shoe comprising an upper and an outsole, said outsole having a front portion capable of receiving a front of a foot, a central portion capable of receiving a middle of the foot, and a rear portion capable of receiving a heel of the foot, wherein said rear portion of said outsole includes the hollow shell, said removable heel pad being removably arranged in the hollow recess formed by said hollow shell and said hollow shell including an inner peripheral lateral wall having an even surface that completely covers and contacts at least one of two longitudinal sides of the heel pad when the heel pad is arranged in the hollow recess, wherein said rear portion has a portion that is thickened relative to said front portion, said thickened portion being adjustable by modifying the thickness of said removable heel pad, wherein said heel pad has an upper face, a lower face, a front side, a rear side that is opposite the front side, and said two longitudinal sides, each of the two longitudinal sides connecting the rear side to the front side of the heel pad, and each of the two longitudinal sides extending along a longitudinal direction of the athletic shoe when the heel pad is arranged in the recess, and wherein the front side of the heel pad forms an incurved lateral face that is a most forward lateral portion of the heel pad, said incurved lateral face to be positioned at said central portion and extending from said lower face to said upper face of the heel pad to connect the lower face to the upper face at said central portion and said incurved lateral face being incurved along the longitudinal direction of the athletic shoe when the heel pad is arranged in the recess so that a thickness of the heel pad decreases progressively towards said front portion of the athletic shoe.

20. The athletic shoe having cleats according to claim 1, wherein the inner peripheral lateral wall of the hollow shell includes a lower portion of constant thickness and an upper portion that is progressively thinner towards a free end of the inner peripheral lateral wall.

* * * * *